US011014399B2

(12) United States Patent
Hannig

(10) Patent No.: US 11,014,399 B2
(45) Date of Patent: May 25, 2021

(54) DIGITAL-PRINTING-STRUCTURED ANTI-WEAR FILM

(71) Applicant: Akzenta Paneele + Profile GMBH, Kaisersesch (DE)

(72) Inventor: Hans-Jürgen Hannig, Bergisch Gladbach (DE)

(73) Assignee: Akzenta Paneele + Profile GMBH, Kaisersesch (DE)

( * ) Notice: Subject to any disclaimer, the term of this patent is extended or adjusted under 35 U.S.C. 154(b) by 0 days.

(21) Appl. No.: 16/959,751

(22) PCT Filed: Jun. 18, 2019

(86) PCT No.: PCT/EP2019/066017
§ 371 (c)(1),
(2) Date: Jul. 2, 2020

(87) PCT Pub. No.: WO2020/069779
PCT Pub. Date: Apr. 9, 2020

(65) Prior Publication Data

US 2020/0406665 A1 Dec. 31, 2020

(30) Foreign Application Priority Data

Oct. 2, 2018 (EP) ..... 18198350

(51) Int. Cl.

| | |
|---|---|
| ***B44C 5/04*** | (2006.01) |
| ***B44C 3/02*** | (2006.01) |
| ***B41M 3/00*** | (2006.01) |
| ***B41M 5/00*** | (2006.01) |

(52) U.S. Cl.
CPC ..... *B44C 3/025* (2013.01); *B41M 3/00* (2013.01); *B41M 5/0047* (2013.01); *B44C 5/04* (2013.01)

(58) Field of Classification Search
CPC ..... B33Y 10/00; B33Y 30/00; B33Y 40/20; B44C 3/025; B44C 5/04; B41M 3/00; B41M 5/0047
See application file for complete search history.

(56) References Cited

U.S. PATENT DOCUMENTS

| | | | | |
|---|---|---|---|---|
| 5,800,904 | A * | 9/1998 | Hallman | B32B 27/06 428/156 |
| 8,865,267 | B2 * | 10/2014 | Dohring | B05D 3/067 427/508 |
| 10,011,702 | B2 * | 7/2018 | Hannig | B44C 5/0476 |
| 10,350,938 | B2 * | 7/2019 | Hoff | B44C 5/04 |
| 2006/0130421 | A1 | 6/2006 | Nollet et al. | |
| 2015/0258716 | A1 * | 9/2015 | Hanning | B23K 26/38 264/400 |
| 2015/0284573 | A1 | 10/2015 | Hannig | |
| 2017/0008334 | A1 * | 1/2017 | Hoff | B44C 5/06 |
| 2017/0305179 | A1 * | 10/2017 | Zhang | B41M 1/18 |
| 2019/0241009 | A1 | 8/2019 | Hannig et al. | |

FOREIGN PATENT DOCUMENTS

| | | | | |
|---|---|---|---|---|
| EP | 2730429 | A1 | 5/2014 | |
| EP | 2740610 | A1 | 6/2014 | |
| WO | WO 2015128255 | * | 9/2015 | B44C 5/06 |
| WO | 2016061455 | A1 | 4/2016 | |
| WO | 2018078043 | A1 | 5/2018 | |

* cited by examiner

*Primary Examiner* — Huan H Tran
(74) *Attorney, Agent, or Firm* — Harness, Dickey & Pierce, P.L.C.

(57) ABSTRACT

The present disclosure proposes a method for producing a structured wear protection film. The method comprises the steps: providing a wear protection base film, applying a formable lacquer-containing cover layer onto at least a partial area of the wear protection base film, at least partial structuring the lacquer-containing cover layer by use of a digital printing process in order to produce a structure of the lacquer-containing cover layer and at least partially hardening the lacquer-containing cover layer. Moreover, a structured wear protection film, the use of a structured wear protection film and a decorative panel comprising a structured wear protection film are proposed. In summary, the above-described method offers the advantage that a particularly detailed structure of a wear protection surface can be obtained, that the structure can be aligned in various ways in a particularly simple manner relative to a decoration, that an economical production of small series is made possible and that restrictions in the process control are alleviated.

14 Claims, No Drawings

DIGITAL-PRINTING-STRUCTURED ANTI-WEAR FILM

CROSS-REFERENCE TO RELATED APPLICATIONS

This application is a U.S. National Phase Application under 35 U.S.C. 371 of International Application No. PCT/EP2019/066017 filed on Jun. 18, 2019, which claims the benefit of European Patent Application No. 18198350.3, filed on Oct. 2, 2018. The entire disclosures of the above applications are incorporated herein by reference.

FIELD

The present disclosure relates to a method for producing a structured wear protection film, a structured wear protection film, the use of a structured wear protection film and a decorative panel comprising a structured wear protection film.

BACKGROUND

This section provides background information related to the present disclosure which is not necessarily prior art.

Structured surfaces for wear protection are known per se and are used in particular for protecting decorative panels.

The term "decorative panel" in the sense of the disclosure means in particular wall, ceiling, door or floor panels which comprise a decoration applied onto a carrier plate. Decorative panels are used in a variety of ways, both in the field of interior design of rooms and as decorative cladding of buildings, for example in exhibition stand construction. One of the most common fields of application of decorative panels is their use as a floor covering, for cladding ceilings, walls and doors. The decorative panels often have a decoration and a surface structure that is intended to imitate a natural material.

Wear or cover layers are generally applied above the decorative layer in order to protect the applied decorative layer. In many cases, it is provided that a surface structure imitating a decorative template is introduced into such wear or cover layers, so that the surface of the decorative panel has a haptically perceptible structure which is adapted to the applied decoration in terms of its shape and pattern, so as to obtain a replication of a natural material as close as possible to the original even with regard to haptics.

Here, in the formation of structured wear protection surfaces with lacquers, the structure is introduced in a known manner by means of embossing tools.

It can be a disadvantageous in such methods that in particular the formation of small and locally limited structures, such as pores, is difficult. In addition, the exact alignment of the embossing tools relative to the decor can cause problems. In addition, variations in the structure can only be realized with great effort and, for example, small production series are comparatively uneconomical, since embossing tools have to be produced and exchanged for each series. Furthermore, it can be disadvantageous that such a structuring may require considerable forces, and to this end the structuring process requires a stable subsurface and is therefore usually carried out directly on the decorative panel. This can result in particular in restrictions in the process control.

The production of structured surfaces for wear protection can therefore still offer room for improvement.

SUMMARY

This section provides a general summary of the disclosure, and is not a comprehensive disclosure of its full scope or all of its features.

It is therefore the object of the present disclosure to provide improved means for structured surfaces for wear protection which at least partially overcome the problems known from the prior art.

The disclosure proposes a method for producing a structured wear protection film. The method comprises the following process steps:

a. providing a wear protection base film,
b. applying a formable lacquer-containing cover layer onto at least a partial area of the wear protection base film,
c. at least partially structuring the lacquer-containing cover layer by use of a digital printing process for producing a structure of the lacquer-containing cover layer, and
d. at least partially hardening the lacquer-containing cover layer.

The claims and detailed description portions of the application provide additional information pertaining to the method as well as a structured wear protection film, use of the structured wear protection film, and a decorative panel with a structured wear protection film.

DETAILED DESCRIPTION

It has surprisingly been found that when a structure is produced in a formable lacquer-containing cover layer on a wear protection film by use of a digital printing process, a particularly detailed structure of the wear protection surface can be obtained. It has also been shown that the structure can be aligned in a particularly simple manner relative to a decoration in various ways. In addition, an economical production of small series is enabled, since no embossing tools have to be produced, and restrictions in the process control are alleviated, since no particularly stable subsurface is required.

In the sense of the disclosure, the term "structured wear protection film" is to be understood as a film which can be applied onto panels or another material and has haptically perceptible structures and protects against wear.

In the sense of the disclosure, the term "wear protection base film" is to be understood as a film which can be applied onto panels or another material, is not required to have any special structure and can serve as a substrate for applying structures.

In the sense of the disclosure, the term "formable" is to be understood as a material that is plastically deformable, that is to say changes its shape due to the action of force. The material can be liquid or solid, for example.

The term "digital printing process" is to be understood in the sense of the disclosure as a computer-controlled direct printing process.

In the sense of the disclosure, the term "hardening" means that the formable material loses its formability. For example, a liquid formable material can be solidified. A plastically deformable solid can, for example, be converted into an elastically deformable solid by hardening. In the case in an at least partial hardening, the material can partially lose its formability, that is to say lose its formability at certain points, for example at the surface. It can also mean that the formability is only reduced and the material does not become completely non-formable. It can also mean a complete hardening.

A previously described method for producing a wear protection film thus serves in particular to improve the production of structured surfaces for wear protection.

In detail, the provision of a wear protection base film provides a substrate on which structuring can take place. By applying a formable lacquer-containing cover layer onto at least a partial area of the wear protection base film, a structurable layer is provided which is held by the wear protection base film and can therefore be easily formed and can nevertheless be guided through the process with the wear protection base film. By partially structuring the lacquer-containing cover layer by use of a digital printing process for producing a structure of the lacquer-containing cover layer a particularly detailed structure of the lacquer-containing cover layer can be obtained. Since no embossing tools have to be used in the digital printing process, the wear protection base film as a substrate can provide sufficient stability for the structuring. By subsequently hardening the now structured lacquer-containing cover layer, the structure introduced is fixed so that it remains essentially unchanged even when force is applied. The above-mentioned advantages result from the interaction of the components.

In one embodiment of the disclosure it can also be provided that the wear protection base film and/or the formable lacquer-containing cover layer comprises a plastic composition, preferably an acrylate-based plastic composition, in particular a polyurethane-modified acrylate plastic composition. It goes without saying that the formable lacquer-containing cover layer includes the plastic composition in a still unhardened form so that the cover layer is formable, and that the wear protection base film comprises the plastic composition in an at least partially hardened form so that it can serve as a substrate for the formable lacquer-containing cover layer.

It is thereby advantageously achieved that the structured wear protection film is flexible as a whole and at the same time comprises particularly good protective properties such as stability, scratch resistance, heat resistance, water resistance and the like.

In a preferred embodiment of the disclosure, the plastic composition can include a dipropylene glycol diacrylate, preferably in an amount of >0 to ≤15 wt.-%, based on the plastic composition, and a reaction product of pentaerythritol, epichlorohydrin and acrylic acid, preferably in an amount of ≥2 to ≤15 wt.-%, based on the plastic composition.

In a preferred embodiment of the disclosure, the plastic composition can additionally comprise a catalyst, preferably in an amount of ≥1 to ≤10 wt.-% t, based on the plastic composition. The catalyst can preferably be a tertiary ammonium salt, in particular a tertiary ammonium salt selected from the group consisting of tetrabutlyammonium bromide, methyltrioctylammonium chloride, benzyltriethylammonium chloride, hexadecyltrimethylammonium bromide and mixtures thereof. In a particularly preferred embodiment of the disclosure, the catalyst can be tetrabutlyammonium bromide.

In a preferred embodiment of the disclosure, the plastic composition can additionally comprise a photoinitiator, preferably in an amount of ≥0.1 to ≤2 wt.-%, based on the plastic composition.

In a preferred embodiment of the disclosure, the photoinitiator can be a phosphine oxide, preferably an aromatic phosphine oxide, in particular phenylbis(2,4,6-trimethylbenzoyl)-phosphine oxide.

In particular, it can be provided that the formable lacquer-containing cover layer and the wear protection base film both have the same plastic composition. It can thereby be achieved that the formable lacquer-containing cover layer and the wear protection base film essentially consist of the same material after the hardening of the lacquer-containing cover layer. Thus, for example, the visual impression of the structured wear protection film is improved, since the wear protection base film and the lacquer-containing cover also have the same optical properties after the hardening and, thus, unwanted light refraction between the two layers can be avoided.

In a further embodiment of the disclosure it can be provided that the wear protection base film and/or the formable lacquer-containing cover layer comprise hard materials, preferably in an amount between 5 wt.-% and 40 wt.-%, wherein the hard materials preferably have an average grain diameter between 10 μm and 250 μm.

In the sense of the disclosure the term "hard materials" is understood as materials which have a sufficient hardness. For example, the hard materials can have a Mohs hardness of at least 8, preferably at least 9. Examples of suitable hard materials are titanium nitride, titanium carbide, silicon nitride, silicon carbide, boron carbide, tungsten carbide, tantalum carbide, aluminum oxide (corundum), zirconium oxide, zirconium nitride or mixtures thereof.

Thus, it is enabled advantageously that the structured wear protection film can be particularly abrasion-resistant. Hard materials in the wear protection base film enable an abrasion protection over the entire surface of the structured wear protection film. Hard materials in the formable lacquer-containing cover layer provide an abrasion protection of the structure after the hardening of the lacquer-containing cover layer. Thus, it is enabled that the structure becomes less blunt due to stress.

In a further embodiment of the disclosure it can be provided that the formable lacquer-containing cover layer has a thickness of ≥1 μm to ≤5 mm, preferably from ≥10 μm to ≤200 μm, in particular from ≥50 μm to ≤60 μm. Here, it can be provided that the lacquer-containing cover layer is applied in a coating amount of ≥50 g/m$^2$ to ≤100 g/m$^2$, preferably ≥60 g/m$^2$ to ≤80 g/m$^2$, for example 70 g/m$^2$.

This advantageously ensures that a sufficiently deep structure can be produced so that a particularly good haptic impression can be achieved. In addition, it is advantageously enabled that the hardening can take place sufficiently quickly so that the structure is not changed by any diffluence of the formable cover layer.

In one embodiment of the disclosure it can be provided that the formable lacquer-containing cover layer comprises a material that can be hardened by electromagnetic radiation, in particular a material that can be hardened by UV radiation and/or IR radiation.

This advantageously ensures that the hardening can take place particularly quickly and locally. According to the disclosure, a material hardenable by electromagnetic radiation means a material in which a chemical reaction can be initiated by electromagnetic radiation, as a result of which the material becomes harder. For example, this chemical reaction can be a polymerization or a crosslinking reaction.

In one embodiment of the disclosure, it can be provided that the partial structuring of the lacquer-containing cover layer is carried out by use of a digital printing process by spraying on a displacement ink by use of an inkjet process.

The term "spraying on" according to the disclosure means that a material is applied as an aerosol jet onto a subsurface in the form of particles and/or drops. According to the disclosure, the term "displacement ink" means an ink, for example a liquid, solution or suspension, which partially displaces a formable material when impinging thereon. According to the disclosure, the term "ink jet process" means a process in which an ink is applied by one or more nozzles in a matrix.

In this way, it is advantageously achieved that the formable lacquer-containing cover layer is structured by the impact of the displacement ink. Here, by the impact of a drop or particle, depressions such as craters or valleys at the bottom of which the ink remains, can be created at places where the ink impacts. As a result of the displacement when the depression is created, moreover, a wall can appear around the depression, which represents a ridge.

In one embodiment of the disclosure it can be provided that the displacement ink essentially consists of an ink composition selected from the group consisting of acrylate-based plastic, polyurethane-modified acrylate plastic, water, organic solvent or mixtures thereof. As a result, it can advantageously be achieved that on the one hand the displacement ink can be sprayed well and on the other hand has good displacement properties.

In a preferred embodiment of the disclosure it can be provided that the ink composition comprises an ethoxyethyl acrylate, preferably 2-(2-ethoxyethoxy)-ethylene acrylate, preferably in an amount of ≥20 to ≤40 wt.-%, based on the ink composition. In addition, it can be provided that the ink composition comprises an ethoxylated polyol esterified with acrylic acid, preferably 1,1,1-trimethylolpropane ethoxylate triacrylate, preferably in an amount of ≥20 to ≤40 wt.-%, based on the ink composition. In addition, it can be provided that the ink composition comprises a urethane acrylate, preferably in an amount of ≥10 to ≤20 wt.-%, based on the ink composition. In addition, it can be provided that the ink composition comprises pentaerythritol acrylic acid ester, preferably in an amount of ≥5 to ≤10 wt.-%, based on the ink composition. Moreover, it can be provided that the ink composition comprises amine-modified acrylic oligomers, in particular reaction products of tripropylene glycol diacrylate with diethylamine, preferably in an amount of ≥5 to ≤10 wt.-%, based on the ink composition.

In one embodiment of the disclosure it can be provided that the displacement ink is hardened when the lacquer-containing cover layer is hardened and is crosslinked together with the lacquer-containing cover layer.

In this way, it is advantageously achieved that a particularly stable structuring can be produced, since the displacement ink binds with the lacquer-containing cover layer.

In one embodiment of the disclosure it can be provided that the displacement ink is evaporated when the lacquer-containing cover layer is hardened.

This advantageously ensures that particularly deep structures are possible, since the displacement ink applied is removed from the depressions again.

In one embodiment of the disclosure it can be provided that a drop speed, a drop volume and a position of the sprayed-on displacement ink are varied according to a three-dimensional digital template.

By varying and controlling the drop speed it can advantageously be achieved that structures with different depths can be produced. It is also achieved that structures with different wall sharpness are created. In particular, it can be varied whether the structure has sharp or blunt edges. By varying the drop volume, moreover, the depth of the structure can be varied. In addition, in particular the width of depressions can be varied. By varying the position, the position of the depressions and elevations are set. Thus, an overall control of the structuring is achieved, so that a desired structure can be generated in accordance with a three-dimensional digital template. The term "three-dimensional digital template" according to the disclosure means a template that reproduces a structure in three dimensions, wherein the template can be provided, for example in the form of a CAD model stored on a digital medium.

In one embodiment of the disclosure, it can be provided that the digital template is generated based on a decoration, wherein the digital template provides complementary depressions and elevations corresponding to the haptic of the decoration.

This advantageously ensures that the haptic perception of the wear protection film matches the visual perception of a decoration, so that, for example, a decorative panel makes a particularly high-quality overall impression.

In one embodiment of the disclosure it can be provided that the hardening is carried out by use of UV radiation with a wavelength in a range from ≥10 nm to ≤450 nm, preferably from ≥200 nm to ≤410 nm.

As a result, a particular rapid and uniform hardening is achieved an advantageous manner.

In a further embodiment of the disclosure it can be provided that the hardening is carried out in a first hardening step by use of UV radiation in a range from ≥315 nm to ≤450 nm, preferably ≥380 nm to ≤410 nm, and in a second hardening step by use of UV radiation in a range from ≥10 nm to ≤250 nm, preferably from ≥170 nm to ≤225 nm.

In this way it can be advantageously achieved that the surface is hardened particularly strongly. In this way, moreover, a particularly high chemical resistance can be achieved. In addition, it can be achieved in this way that a good hardening is possible even without photoinitiators or with only a small amount of a photoinitiator. Furthermore, a hardening with only small heat input is enabled.

In a further embodiment of the disclosure, it can in particular be provided that the lacquer-containing cover layer is irradiated with UV radiation from a radiation source with a power of ≥5 to ≤30 W/cm in the second hardening step.

As a result, it can advantageously be achieved that only little heat is introduced into the lacquer-containing cover layer during the hardening process. As a result, moreover, undesired deformations can be avoided while the lacquer-containing cover layer can nevertheless be adequately hardened.

In one embodiment of the disclosure, it can be provided that during the hardening, in particular in the second hardening step, the volume between the UV radiation source and the lacquer-containing cover layer has an inert gas atmosphere. This means that an inert gas, for example $N_2$ or a noble gas, has essentially displaced the air in the area between the UV radiation source and the lacquer-containing cover layer. In particular, this means that essentially no oxygen is exposed to the direct UV radiation between the UV radiation source and the lacquer-containing cover layer.

Thus, it can be achieved in an advantageously way that drying is made possible with particularly short wavelengths. It can be achieved that the UV radiation is absorbed comparatively less. In addition, it can be achieved that the UV radiation does not cause any reactions in the air, such as the reaction that results in ozone. In addition, undesirable surface reactions can be avoided, so that a particularly stable surface is created.

In one embodiment of the disclosure, it can be provided that the hardening begins less than 5 s, preferably less than 2 s, in particular less than 0.5 s after the structuring.

It is thereby advantageously achieved that the structuring does not change due to subsequent diffluence prior to the hardening process.

In one embodiment of the disclosure it can be provided that the formable lacquer-containing cover layer is prehardened prior to the structuring process.

It is thus advantageously achieved that the viscosity of the lacquer-containing cover layer can be adjusted. In this way, it can be achieved that the structuring can be produced accurate in every detail. This can also mean that a hardening process is initiated shortly before the structuring process, so that during the structuring the structures formed reach a hardness which is sufficient to prevent them from subsequently diffluence prior to a final hardening.

In one embodiment of the disclosure it can be provided that the method additionally comprises the steps:

e. providing a carrier comprising a decoration on at least a partial area of the carrier, and f. applying the wear protection base film onto the decoration, wherein the wear protection base film is applied onto the decoration prior to the application, structuring and at least partial hardening of the lacquer-containing cover layer, wherein the structuring of the lacquer-containing cover layer is preferably created at least partially in synchronism with the decoration.

It is thereby advantageously achieved that the structuring can be applied directly in synchronization with a decoration. For example, by use of alignment marks, the structuring can be directly aligned with the digital printing process so that the structuring is created synchronously with the decoration.

A "carrier" can in particular be understood as a layer which serves as the core or as a base layer in a finished panel and can in particular comprise a natural material, such as a wood material, a fiber material or a material comprising a plastic. For example, the carrier can impart a panel a suitable stability or contribute thereto.

Wood materials in the sense of the disclosure in addition to solid wood materials are also materials such as cross-laminated timber, glue-laminated timber, blockboard, veneered plywood, laminated veneer lumber, parallel strand lumber and bending plywood. In addition, wood materials in the sense of the disclosure are also to be understood as chipboards such as pressboards, extruded boards, oriented structural boards (OSB) and laminated strand lumber as well as wood fiber materials such as wood fiber insulation boards (HFD), medium hard and hard fiberboards (MB, HFH) and in particular medium density fiberboards (MDF) and high density fiberboards (HDF). Even modern wood materials such as wood polymer materials (wood plastic composite, WPC), sandwich boards made of a lightweight core material such as foam, rigid foam or honeycomb paper and a layer of wood applied thereto, and minerally cured, for example with cement, chipboards are wood materials in the sense of the disclosure. Moreover, cork represents a wood material in the sense of the disclosure.

Plastics which can be used in the production of corresponding panels or the carriers are, for example, thermoplastic plastics, such as polyvinyl chloride, polyolefins (for example polyethylene (PE), polypropylene (PP)), polyamides (PA), polyurethanes (PU), polystyrene (PS), acrylonitrile butadiene styrene (ABS), polymethyl methacrylate (PMMA), polycarbonate (PC), polyethylene terephthalate (PET), polyether ether ketone (PEEK) or mixtures or copolymers thereof. The plastics can include conventional fillers such as calcium carbonate (chalk), alumina, silica gel, quartz powder, wood flour, gypsum. They may also be colored in a known manner.

The carrier can in particular be a web-like carrier or plate-like carrier. A "web-like carrier" can be understood as a carrier which, for example, has a web-like length in its manufacturing process and is therefore significantly longer in comparison to its thickness or width and whose length can be, for example, greater than 15 meters.

In the sense of the present disclosure, a "plate-shaped carrier" can further be understood as a carrier which is formed by separation from the web-like carrier and is formed in the shape of a plate. Moreover, the plate-shaped carrier may already define the shape and/or size of the panel to be produced. However, the plate-shaped carrier can also be provided as a large plate. A large plate in the sense of the disclosure is in particular a carrier whose dimensions several times exceed the dimensions of the final decorative panels, and which in the course of the manufacturing process is separated in a corresponding plurality of decorative panels, for example by sawing, laser or water jet cutting. For example, the large plate can correspond to the web-shaped carrier.

A decoration can, for example, be applied onto the carrier, for example by a printing process. Here, further a suitable printing subsurface can be provided on the carrier. Alternatively, it is not excluded in the sense of the present disclosure that the decoration is applied in such a way that, for example, an already printed fiber layer, such as a paper layer, or also an already printed film, such as made of polyethylene, polypropylene or polyvinyl chloride, is applied onto the carrier.

In the sense of the disclosure the term fiber materials means materials such as paper and nonwoven fabrics on the basis of plant, animal, mineral or even synthetic fibers as well as cardboards. Examples of fiber materials on the basis of plant fibers in addition to papers and nonwoven fabrics made of cellulose fibers are boards made of biomass such as straw, maize straw, bamboo, leaves, algae extracts, hemp, cotton or oil palm fibers. Examples of animal fiber materials are keratin-based materials such as wool or horsehair. Examples of mineral fiber materials are mineral wool or glass wool.

The decoration can also be provided with a lacquer-containing layer which after the application of the wear protection base film is located between the wear protection base film and the decoration.

The disclosure moreover proposes a structured wear protection film.

In detail, a structured wear protection film is provided, preferably produced by the method according to the disclosure, comprising a wear protection base film with a lacquer-containing cover layer applied and fixed to at least a partial area of the wear protection base film, wherein the lacquer-containing cover layer comprises structures produced by the digital printing process.

By means of such a wear protection film it can be achieved that a material to be protected is protected against wear. The film can already be applied to a material to be protected or can be provided separately. In this way it is advantageously achieved that the film, for example in contrast to an exclusively directly applied wear protection layer, can be applied flexibly to a material to be protected. As a result, such a film can advantageously be produced independently of the material to be protected.

The disclosure also proposes the use of a structured wear protection film according to the disclosure. In detail, the use of a structured wear protection film for protecting a decorative panel is provided, wherein the decorative panel comprises a carrier and a decoration on at least a partial area of the carrier and the structured wear protection film is applied onto the decor, wherein during the application of the structured wear protection film the structure of the lacquer-containing cover layer is at least partially synchronously aligned with the decoration. This means that the structured wear protection film is only applied to a decorative panel after the production. The at least partially synchronous alignment of the structure of the wear protection film with the decoration can be realized, for example, by use of alignment marks.

The use according to the disclosure advantageously ensures that the production of protected decorative panels has greater flexibility. The subsequent application of the structured wear protection film according to the disclosure also prevents the panel from being deformed due to possible shrinkage during the hardening of wear protection layers directly on the panel.

The disclosure also proposes a decorative panel comprising a structured wear protection film.

In detail, a decorative panel comprising a structured wear protection film is provided, wherein the decorative panel comprises a carrier, with a decoration applied to at least a partial area and a structured wear protection film according to the disclosure applied onto the decoration, and wherein the structures of the structured wear protection film are synchronous with the decoration in at least some partial areas. In Addition, a suitable printing subsurface can be provided between the carrier and the decoration. The decoration can also be provided with a lacquer-containing layer which is located between the wear protection film and the decoration.

It can thereby be achieved that the decorative panel is well protected against wear and at the same time has a particularly detailed structure, the haptic perception of which matches the optical perception of a decoration, so that a particularly high-quality overall impression is achieved.

The invention claimed is:

1. A method for producing a structured wear protection film, comprising the steps:

a. providing a wear protection base film;

b. applying of a formable lacquer-containing cover layer onto at least a partial area of the wear protection base film;

c. at least partially structuring the lacquer-containing cover layer by use of a digital printing process in order to produce a structure of the lacquer-containing cover layer; and d. at least partially hardening the lacquer-containing cover layer, wherein the partial structuring of the lacquer-containing cover layer by use of a digital printing process is carried out by spraying a displacement ink by use of an ink jet process.

2. The method according to claim 1, wherein the wear protection base film and/or the formable lacquer-containing cover layer comprises an acrylate-based plastic composition, in particular a polyurethane-modified acrylate plastic composition.

3. The method according to claim 1, wherein the wear protection base film and/or the formable lacquer-containing cover layer comprises hard materials, preferably in an amount between 5 wt.-% and 40 wt.-%, wherein the hard materials preferably have an average grain diameter between 10 μm and 250 μm.

4. The method according to claim 1, wherein the formable lacquer-containing cover layer has a thickness of ≥1 μm to ≤5 mm, preferably from ≥1 μm to ≤200 μm, in particular from ≥1 μm to ≤20 μm.

5. The method according to claim 1, wherein the formable lacquer-containing cover layer comprises a material which is hardenable by electromagnetic radiation, in particular a material which is hardenable by UV radiation and/or IR radiation.

6. The method according to claim 1, wherein a drop speed, a drop volume and a position of the sprayed displacement ink are varied according to a three-dimensional digital template.

7. The method according to claim 1, wherein the hardening is carried out by use of UV radiation with a wavelength in a range from ≥10 nm to ≤450 nm.

8. The method according to claim 1, wherein the hardening is carried out in a first hardening step by use of UV radiation in a range from ≥315 nm to ≤450 nm, preferably ≥380 nm to ≤410 nm, and in a second hardening step by use of UV radiation in a range from ≥10 nm to ≤250 nm, preferably from ≥170 nm to ≤225 nm.

9. The method according to claim 1, additionally comprising the steps:

g. providing a carrier which comprises a decoration on at least a partial area of the carrier; and h. applying the wear protection base film onto the decoration, wherein the application of the wear protection base film onto the decoration is carried out prior to the application, structuring and at least partial hardening of the lacquer-containing cover layer, wherein the structure of the lacquer-containing cover layer is preferably created at least partially in synchronism with the decoration.

10. A structured wear protection film preferably produced by the method according to claim 1, comprising a wear protection base film with a lacquer-containing cover layer applied and fixed at least to a partial area of the wear protection base film, wherein the lacquer-containing cover layer comprises structures created by the digital printing process.

11. Use of a structured wear protection film according to claim 10 for protecting a decorative panel, wherein the decorative panel comprises a carrier and a decoration on at least a partial area of the carrier and the structured wear protection film is applied onto the decoration, and wherein during the application of the structured wear protection film the structure of the lacquer-containing cover layer is at least partially aligned with the decoration.

12. A decorative panel with a structured wear protection film, comprising a carrier with a decoration applied onto at least one partial area and a structured wear protection film according to claim 10 applied onto the decoration, wherein the structures of the structured wear protection film are synchronous with the decoration at least in some partial areas.

13. The method according to claim 1, wherein the displacement ink consists essentially of an ink composition selected from the group consisting of acrylate-based plastic, polyurethane-modified acrylate plastic, water, organic solvent or mixtures thereof.

14. The method according to claim 6, wherein the digital template is generated based on a decoration, wherein the digital template provides complementary recesses and elevations corresponding to the haptic of the decoration.

* * * * *